US007748674B2

(12) United States Patent
Wooten

(10) Patent No.: US 7,748,674 B2
(45) Date of Patent: Jul. 6, 2010

(54) SHELF BRACKET AND METHOD OF MAKING SAME

(75) Inventor: Donald W. Wooten, Arlington, TX (US)

(73) Assignee: Wooten Metal, Inc., Dallas, TX (US)

( * ) Notice: Subject to any disclaimer, the term of this patent is extended or adjusted under 35 U.S.C. 154(b) by 0 days.

(21) Appl. No.: 11/827,337

(22) Filed: Jul. 11, 2007

(65) Prior Publication Data

US 2008/0017772 A1 Jan. 24, 2008

Related U.S. Application Data

(63) Continuation-in-part of application No. 11/269,010, filed on Nov. 8, 2005.

(60) Provisional application No. 60/643,939, filed on Jan. 14, 2005.

(51) Int. Cl.
*A47G 29/02* (2006.01)

(52) U.S. Cl. ..... 248/248; 248/216.4; 248/903; 248/909

(58) Field of Classification Search ..... 248/248, 248/300, 216.4, 217.1, 217.3, 903, 909; 403/231
See application file for complete search history.

(56) References Cited

U.S. PATENT DOCUMENTS

| | | | | | |
|---|---|---|---|---|---|
| 2,739,777 | A | * | 3/1956 | Schoenhardt | 248/243 |
| 2,845,187 | A | * | 7/1958 | Bianchi | 108/147.17 |
| 3,041,033 | A | | 6/1962 | Schwartz | |
| 4,313,587 | A | * | 2/1982 | Loeschen | 248/217.2 |
| 4,804,159 | A | * | 2/1989 | Martel | 248/248 |
| 5,318,264 | A | | 6/1994 | Meiste | |
| 5,364,052 | A | * | 11/1994 | De Gruttis | 248/245 |
| 5,797,694 | A | * | 8/1998 | Breivik | 403/231 |

* cited by examiner

*Primary Examiner*—Korie Chan

(57) ABSTRACT

A shelf bracket having a ledge and a plurality of side members, the shelf bracket being formed from a blank. The blank has a plurality of side portions, which can be bent downwardly to create the side members. The blank also has a ledge portion which forms the ledge of the shelf bracket. The side portions and the ledge portion of the blank are separated by a plurality of bend lines, to facilitate bending for the formation of the shelf bracket. The blank desirably has a lip portion which can be bent upwardly to form a lip of the shelf bracket. The blank can also have a plurality of stiffener portions which can be bent to create stiffeners in the shelf bracket, and one or more ribs in the side portions to provide strength to the shelf bracket.

8 Claims, 9 Drawing Sheets

SHELF BRACKET AND METHOD OF MAKING SAME

CROSS REFERENCE TO RELATED APPLICATIONS

The present application is a continuation-in-part of the nonprovisional patent application identified by U.S. Ser. No. 11/269,010 filed Nov. 8, 2005, which claims priority to the provisional patent application identified by U.S. Ser. No. 60/643,939, filed on Jan. 14, 2005, the entire contents of both are hereby incorporated herein by reference.

STATEMENT REGARDING FEDERALLY SPONSORED RESEARCH OR DEVELOPMENT

Not applicable.

DETAILED DESCRIPTION OF THE PREFERRED EMBODIMENT OF THE INVENTION

Figure 1:
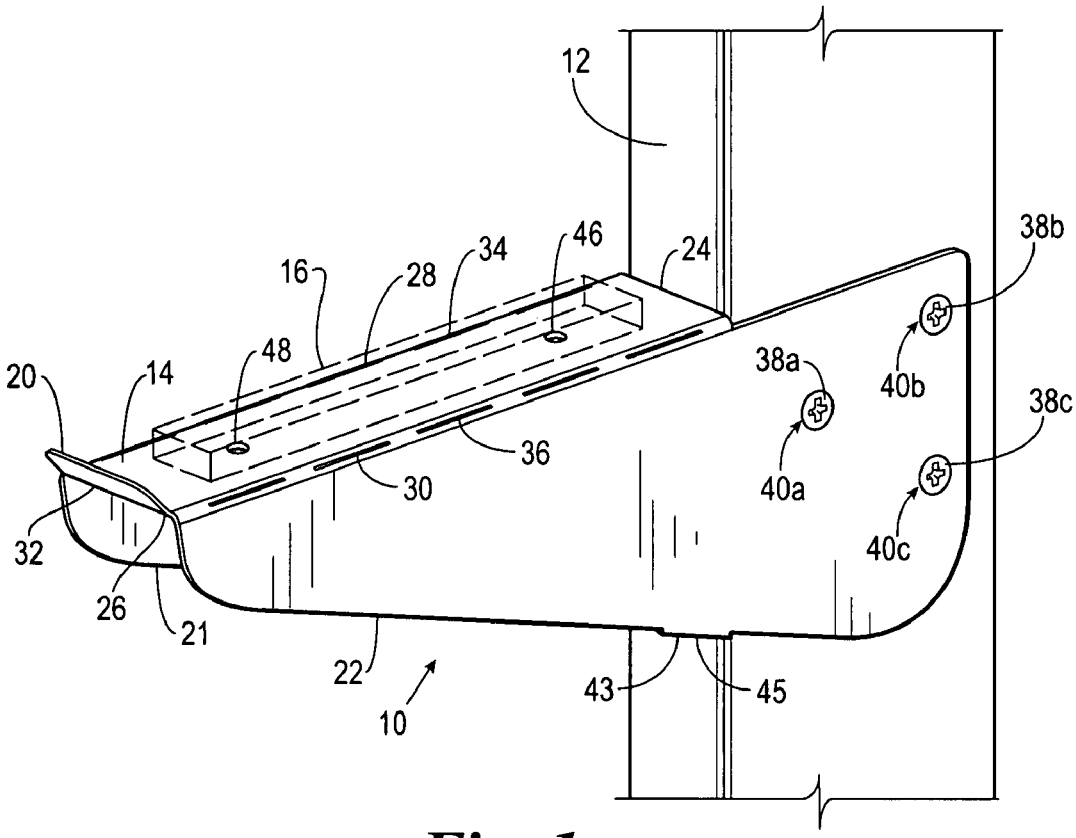
FIG. 1 is a perspective view of a shelf bracket, constructed in accordance with the present invention, connected to a support.
Figure 2:
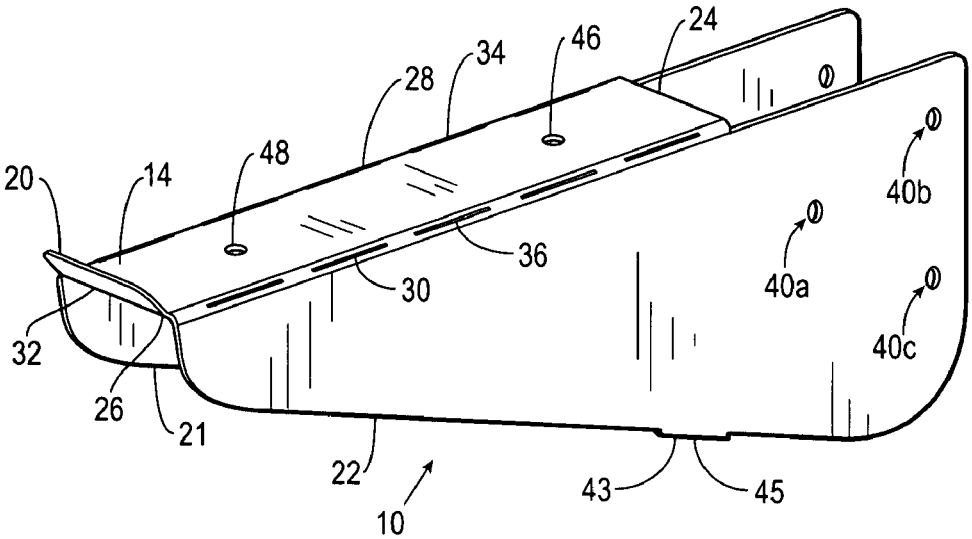
FIG. 2 is a perspective view of the shelf bracket depicted in FIG. 1.

Referring now to the drawings, and in particular to FIGS. 1-2, shown therein and designated by a reference numeral 10 is a shelf bracket constructed in accordance with the present invention. The shelf bracket 10 is connected to a support 12 (shown in FIG. 1) such that a ledge 14 of the shelf bracket 10 is capable of supporting a load 16 (shown in FIG. 1). The support 12 can be any type of post, or vertical support capable of supporting the shelf bracket 10. For example, the support 12 can be a 2×4 stud utilized commonly in the building construction industry, particularly in barns and sheds where additional storage capacity is desirable. The load 16 can be anything capable of being supported by the shelf bracket 10. For example, it is envisioned that more than one of the shelf bracket 10 will be utilized for forming a shelving unit (not shown). In this case, at least two of the shelf brackets 10 would be utilized with the shelf brackets 10 being spaced a distance laterally apart. In this instance, the load 16 will commonly include a shelf which is positioned upon the ledges 14 upon which other types of loads, such as paint cans, coolers, books, or the like will be stored.

The shelf bracket 10 is also provided with a lip 20, and a pair of side members 21 and 22. The ledge 14 is provided with a first end 24, a second end 26, a first side 28, and a second side 30. The lip 20 is connected to the second end 26 of the ledge 14, and extends a distance therefrom. The lip 20 is preferably separated from the ledge 14 via a bend line 32 extending between the lip 20 and the ledge 14. The side member 21 is connected to the first side 28 of the ledge 14, and extends a distance downwardly therefrom generally at an angle of about 90°. In a similar manner, the side member 22 is connected to the second side 30 of the ledge 14 and also extends downwardly therefrom at an angle of about 90°. The side member 21, and the side member 22 are separated from the ledge 14 via bend lines 34 and 36. The bend lines 32, 34 and 36 form weakened linear areas within the shelf bracket 10 and can be formed by any suitable method, such as a series of round holes, a series of slots, or a laser cutline. Shown by way of example in FIG. 1 are the bend lines 32, 34 and 36 being formed from a series of slots.

The side members 21 and 22 extend past the first end 24 of the ledge 14 so as to form a cavity into which the support 12 is positioned. The first end 24 of the ledge 14 engages the support 12 when the shelf bracket 10 is installed on the support 12, and the side members 21 and 22 wrap around the support 12 so that the side members 21 and 22 can engage the support 12. For example, as shown in FIG. 1, the side members 21 and 22 can be connected to the support 12 by a plurality of fasteners 38 (the fasteners 38 are designated as 38*a*, 38*b* and 38*c* for purposes of clarity) positioned through a plurality of openings 40 (the openings 40 are designated as 40*a*, 40*b* and 40*c* for purposes of clarity) and secured to the support 12.

Figure 3:
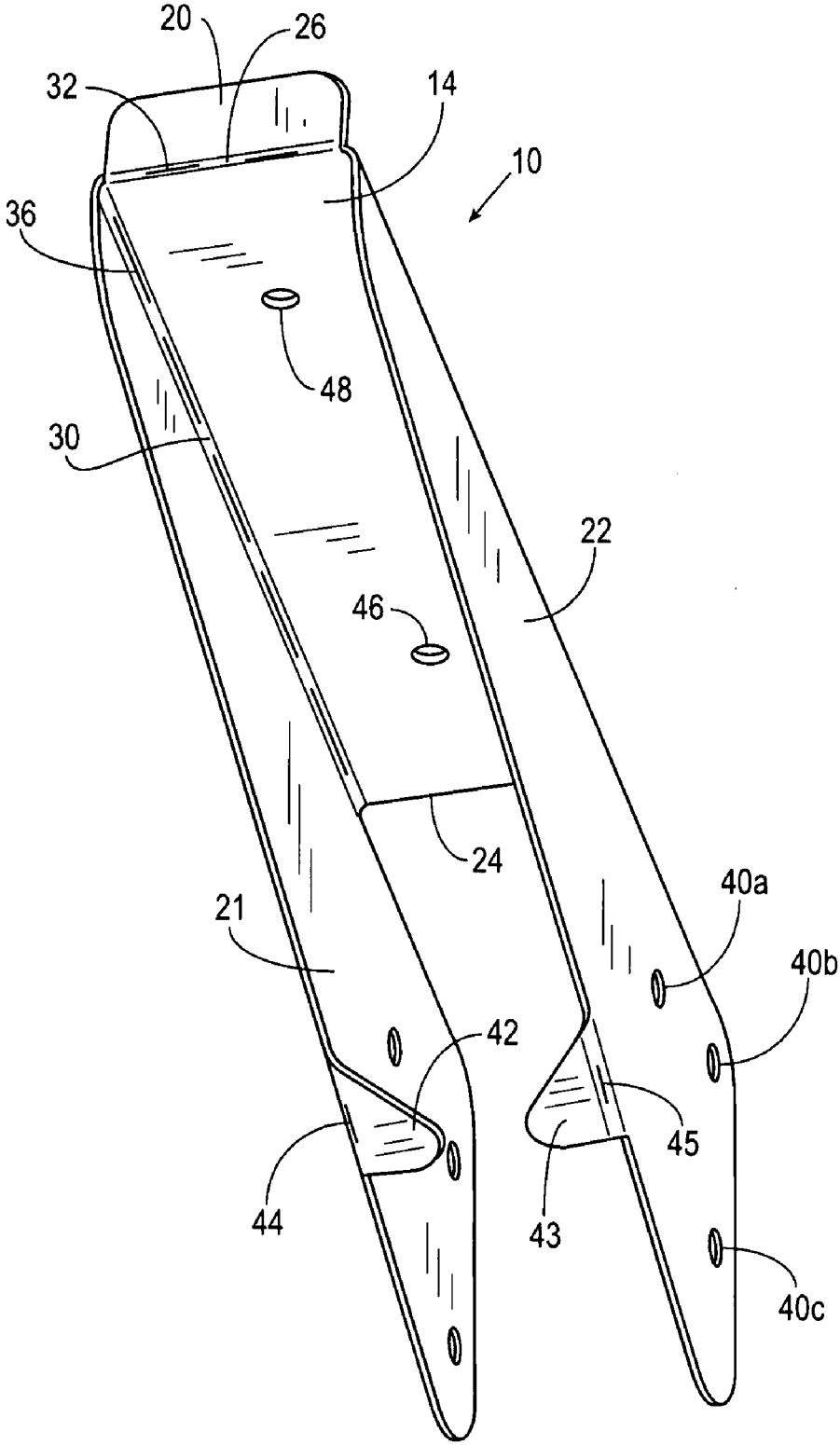
FIG. 3 is another perspective view of the shelf bracket depicted in FIG. 1, showing an underside of the shelf bracket.

To stabilize the shelf bracket 10 on the support 12, the shelf bracket 10 is provided with a pair of stiffeners 42 (shown in FIG. 3) and 43. The stiffeners 42 and 43 are connected to and extend inwardly from the side members 21 and 22. The stiffeners 42 and 43 are preferably separated from the side members 21 and 22 via bend lines 44 and 45 extending between the stiffeners 42 and 43 and the side members 21 and 22. The stiffeners 42 and 43 engage the support 12 to prevent downward rotation of the shelf bracket 10 on the support 12. The stiffeners 42 and 43 are aligned with the first end 24 of the ledge 14 so that when the stiffeners 42 and 43, and first end 24 of the ledge 14 are positioned against the support 12 the ledge 14 extends generally 90° away from the support 12.

To secure the load 16 on the ledge 14, the shelf bracket 10 can be provided with any suitable assembly. For example, the shelf bracket 10 can be provided with openings 46 and 48 extending through the ledge 14 so that a fastener, such as a screw can be inserted through the openings 46 and 48 and secured to the load 16.

Figure 4:
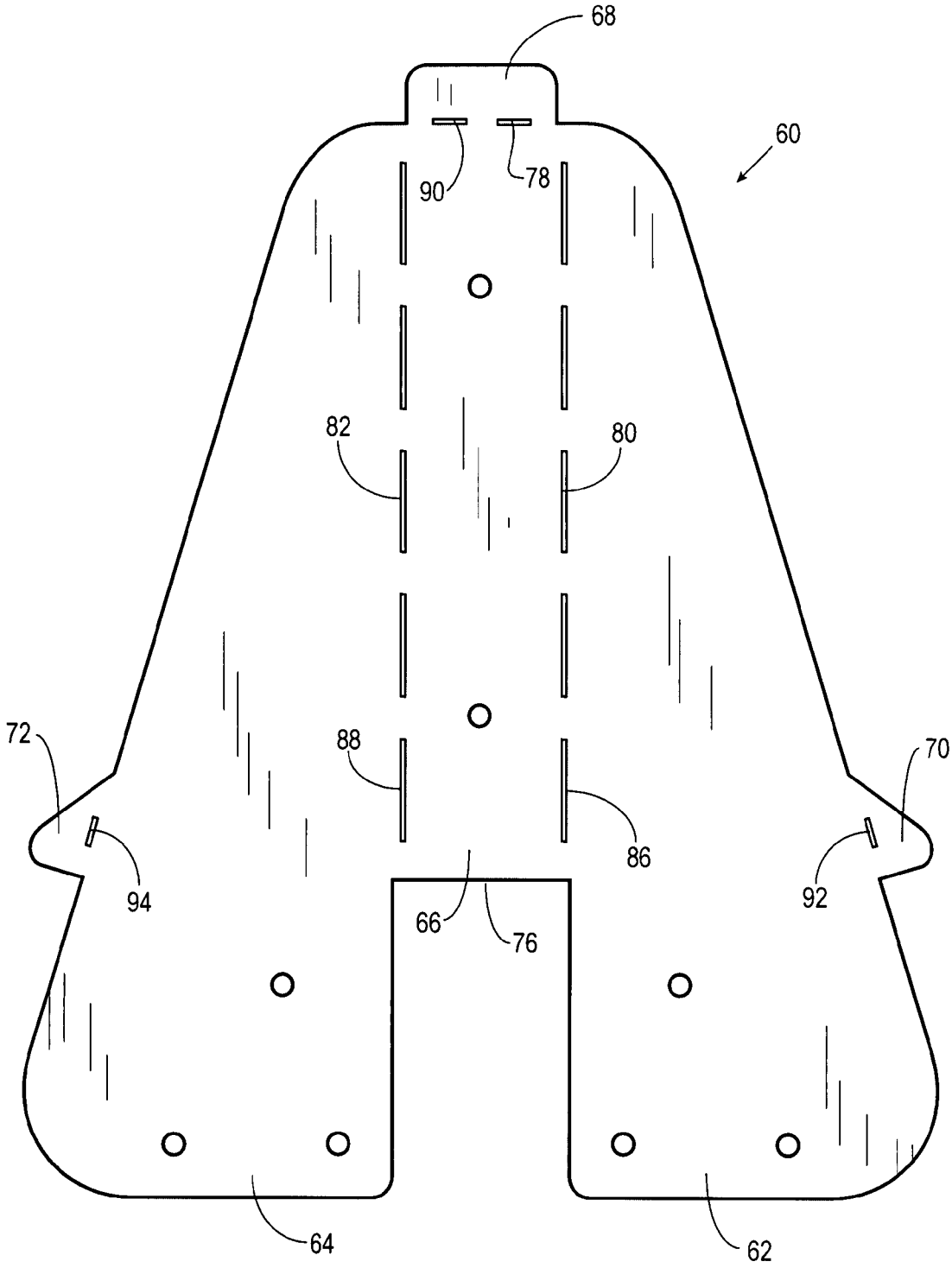
FIG. 4 is a top plan view of a blank utilized for forming the shelf bracket depicted in FIG. 1.
Figure 5:
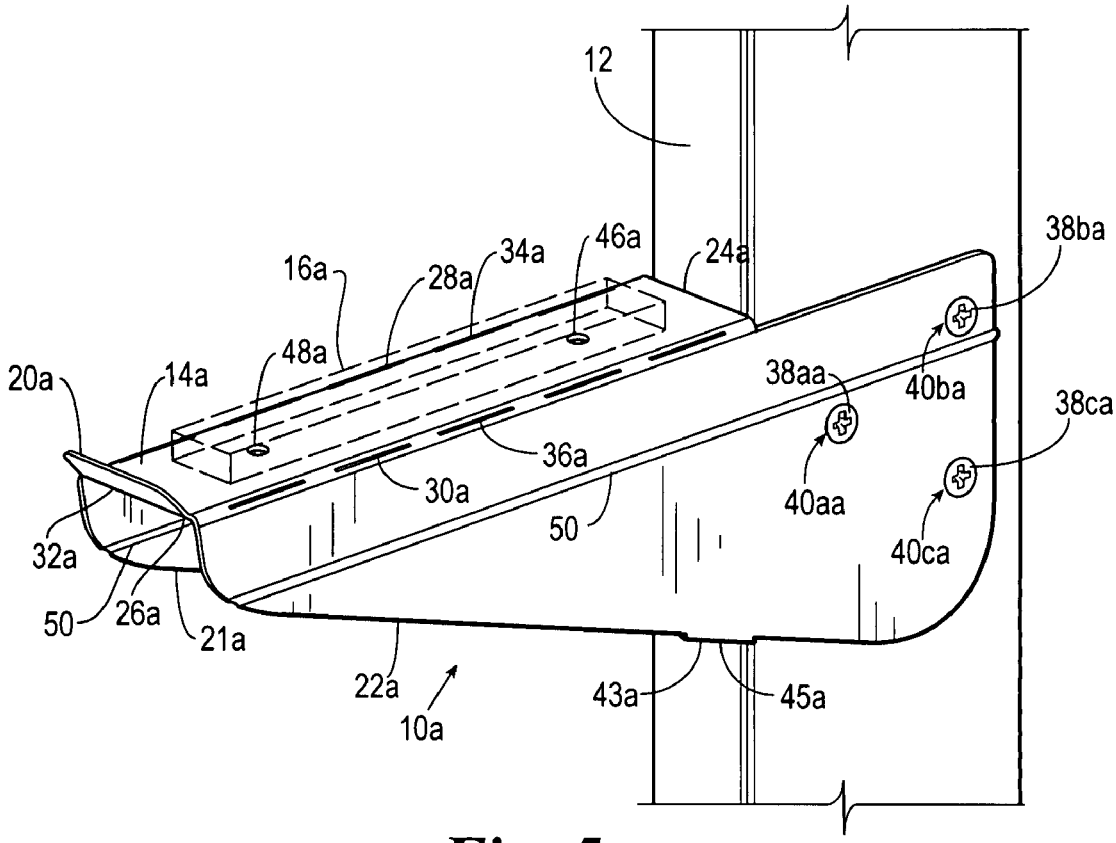
FIG. 5 is a perspective view of another shelf bracket constructed in accordance with the present invention having one or more rib formed in side members to provide the shelf bracket with additional strength.
Figure 6:
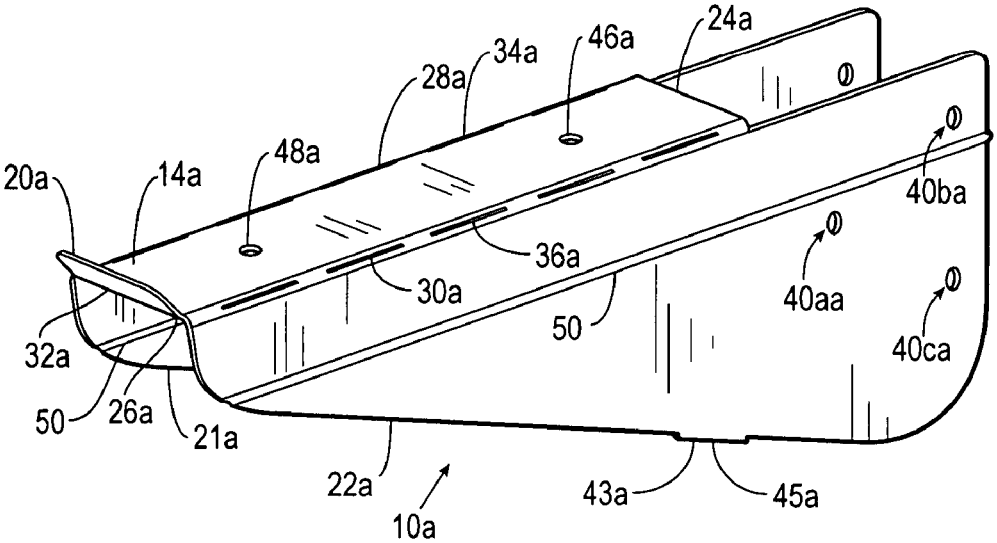
FIG. 6 is a perspective view of the shelf bracket of FIG. 5.
Figure 7:
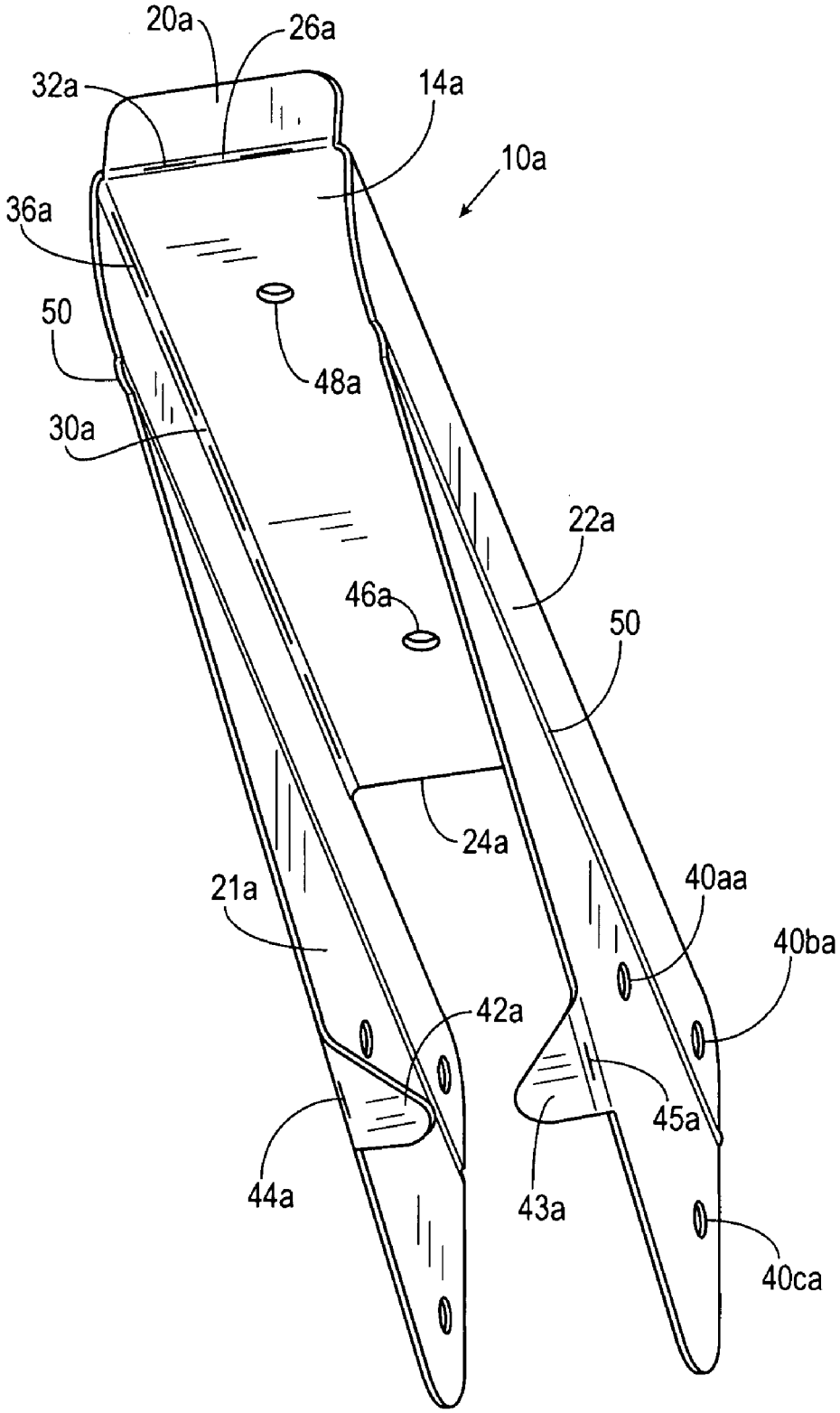
FIG. 7 is another perspective view of the shelf bracket of FIG. 5, showing an underside of the shelf bracket.
Figure 8:
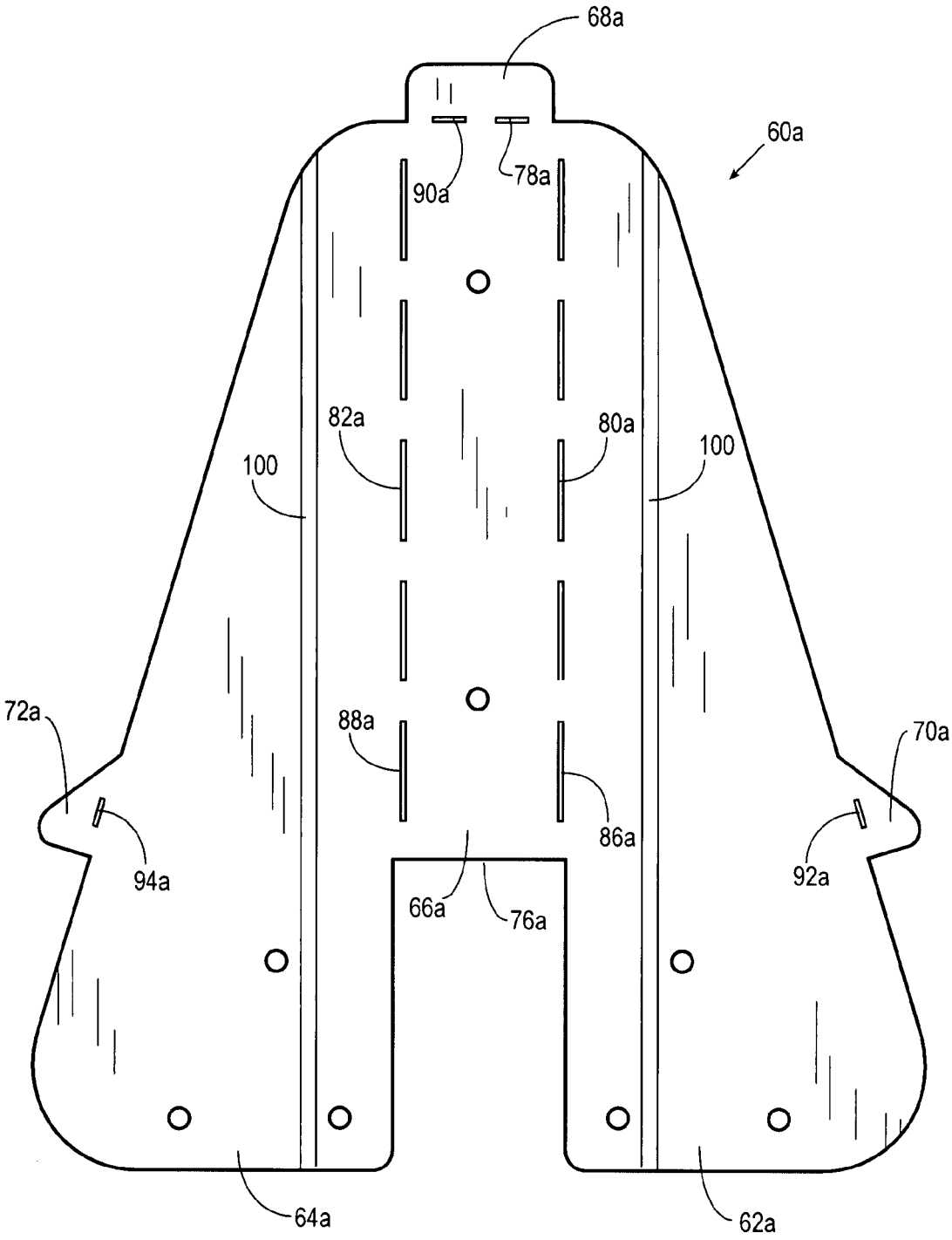
FIG. 8 is a top plan view of a blank utilized for forming the shelf bracket depicted in FIG. 5.

Referring now to FIG. 4, shown therein is a blank 60 which can be utilized for forming the shelf bracket 10. The blank 60 is preferably constructed of a single sheet of material. The thickness, and/or construction of the material will vary based upon the desired use of the shelf bracket 10. For example, where the shelf bracket 10 will be utilized at an individual's home for supporting rather small loads 16, such as paint cans, the blank 60 can be constructed of a material such as 18-22 gauge steel.

The blank 60 is provided with a substantially triangular shape. However, it should be understood that the blank 60 can be provided with any shape so long as the blank 60 can be utilized as described herein. The blank 60 defines a first side portion 62, a second side portion 64, a ledge portion 66, a lip portion 68, a first stiffener portion 70, and a second stiffener portion 72.

The ledge portion 66 is provided with a first end 76, a second end 78, a first side 80, and a second side 82. The first side portion 62 borders the first side 80 of the ledge portion 66, and is separated therefrom by way of a bend line 86. The second side portion 64 borders the second side 82 of the ledge portion 66 and is separated therefrom by way of a bend line 88. The lip portion 68 borders the second end 78 of the ledge portion 66 and is separated therefrom by way of a bend line 90. The first stiffener portion 70 borders an outer side of the first side portion 62 and is separated therefrom by way of a bend line 92. The second stiffener portion 72 borders an outer side of the second side portion 64 and is separated therefrom by way of a bend line 94. The bend lines 86, 88, 90, 92 and 94 can be formed from any suitable process for weakening the blank 60 in these areas. For example, the bend lines 86, 88, 90, 92 and 94 can be formed by a series of circular cut outs, slots, or laser cutline.

The blank 60 can be formed from any suitable process. For example, the blank 60 can be formed by stamping, laser cutting, water jet cutting, or the like. Further, it should be understood that the blank 60 can be constructed from more than one piece of material that have been connected.

To form the shelf bracket 10 from the blank 60, the first side portion 62, and the second side portion 64 are bent approximately 90° with respect to the ledge portion 66 so that the first side portion 62 forms the side member 21, and the second side portion 64 forms the side member 22. The ledge portion 66 of the blank 60 forms the ledge 14 of the shelf bracket 10.

To prevent the load 16 from falling off of the ledge 14, the lip portion 68 can be bent upwardly, in a direction generally opposite the direction in which the first side portion 62 and the second side portion 64 have been bent. Additionally, the first stiffener portion 70, and the second stiffener portion 72 can be bent inwardly to form the stiffeners 42 and 43 depicted in FIG. 3.

It should be understood that the blank 60 is designed to be bent into the shelf bracket 10 by an individual using tools normally owned by a homeowner. Thus, it should be understood that the blank 60 can be bent using either the hands of the individual, a small hand-operated tool, such as a pair of pliers or a hammer, or perhaps a homeowner's shop vise.

Referring now to FIGS. 5-8, shown therein and designated by a reference numeral 10*a* is another version of a shelf bracket constructed in accordance with the present invention. The shelf bracket 10*a* is similar in construction and function to the shelf bracket 10 described above with reference to FIGS. 1-4 respectively. The common features between the shelf bracket 10*a* and the shelf bracket 10 will not be described hereinafter for purposes of brevity. However, the common features will be labeled in FIGS. 5-8 with the same numeric prefix followed by an "a" alphabetic suffix.

The shelf bracket 10*a* is provided with a pair of side members 21*a* and 22*a* having at least one rib 50 formed in each of the side members 21*a* and 22*a*. The ribs 50 provide additional strength to the side members 21*a* and 22*a* so that a thinner material can be used in forming the side members 21*a* and 22*a*. Although only one rib 50 is shown in each of the side members 21*a* and 22*a*, it should be understood that more than one rib 50 can be provided in each of the side members 21*a* and 22*a* to provide for even additional strength. The more than one rib 50 in each of the side members 21*a* and 22*a* can be either spaced apart, or contiguous.

Although the rib 50 is shown as extending generally across the entire side member 21*a*, it should be understood that the rib 50 can extend only partially across the side member 21*a*. Further, multiple ribs 50 can be positioned in certain areas of the side members 21*a* so as to increase the strength in such areas, while other areas of the side members 21*a* could be devoid of such ribs 50.

Furthermore, although the ribs 50 are shown as extending generally parallel to the ledge portion of the shelf bracket 10*a*, it should be understood that the ribs 50 can extend at any desirable angle or orientation with respect to the ledge portion of the shelf bracket 10*a*.

The ribs 50 desirable form a "u" or a "v" cross-sectional shape on the side members 21*a* and 22*a* of the shelf bracket 10. However, it should be understood that the rib 50 may have any shape and be in any location on the shelf bracket 10.

Referring now to FIG. 4, shown therein is a blank 60*a* which can be utilized for forming the shelf bracket 10*a*. The blank 60*a* is preferably constructed of a single sheet of material. The thickness, and/or construction of the material will vary based upon the desired use of the shelf bracket 10*a*. For example, where the shelf bracket 10 will be utilized at an individual's home for supporting rather small loads 16, such as paint cans, the blank 60*a* can be constructed of a material such as 18-30 gauge steel or other light gauge material.

The blank 60*a* is provided with a substantially triangular shape. However, it should be understood that the blank 60*a* can be provided with any shape so long as the blank 60*a* can be utilized as described herein. The blank 60*a* defines a first side portion 62*a*, a second side portion 64*a*, a ledge portion 66*a*, a lip portion 68*a*, a first stiffener portion 70*a*, and a second stiffener portion 72*a*.

The ledge portion 66*a* is provided with a first end 76*a*, a second end 78*a*, a first side 80*a*, and a second side 82*a*. The first side portion 62*a* borders the first side 80*a* of the ledge portion 66*a*, and is separated therefrom by way of a bend line 86*a*. The second side portion 64*a* borders the second side 82*a* of the ledge portion 66*a* and is separated therefrom by way of a bend line 88*a*. The lip portion 68*a* borders the second end 78*a* of the ledge portion 66*a* and is separated therefrom by way of a bend line 90*a*. The first stiffener portion 70*a* borders an outer side of the first side portion 62*a* and is separated therefrom by way of a bend line 92*a*. The second stiffener portion 72*a* borders an outer side of the second side portion 64*a* and is separated therefrom by way of a bend line 94*a*. The bend lines 86*a*, 88*a*, 90*a*, 92*a* and 94*a* can be formed from any suitable process for weakening the blank 60*a* in these areas. For example, the bend lines 86*a*, 88*a*, 90*a*, 92*a* and 94*a* can be formed by a series of circular cut outs, slots, or laser cutline(s).

The blank 60*a* is also provided with at least two rib portions 100 which form the ribs 50 when the blank 60*a* is formed into the shelf bracket 10*a*. Each of the rib portions 100 extending across or inside one the first side portion 62*a*, or the second side portion 64*a*. The rib portions 100 provide additional strength to the side members 21*a* and 22*a* when the blank 60*a* is formed into the shelf bracket 10*a* so that a thinner material can be used in forming blank 60*a*. This reduces the cost of the blank 60*a*. Although only one rib portion 100 is shown in each of the side portions 62*a* and 64*a*, it should be understood that more than one rib portion 100 can be provided in each of the side portions 62*a* and 64*a* to provide for even additional strength. The more than one rib portion 100 in each of the side portions 62*a* and 64*a* can be either spaced apart, or contiguous.

The blank 60*a* can be formed from any suitable process. For example, the blank 60*a* can be formed by stamping, laser cutting, water jet cutting, extrusion, molding or the like. The rib portion 100 can be formed by any suitable method, such as embossing, or stamping or the like. Further, it should be understood that the blank 60*a* can be constructed from more than one piece of material that have been connected.

Figure 9:
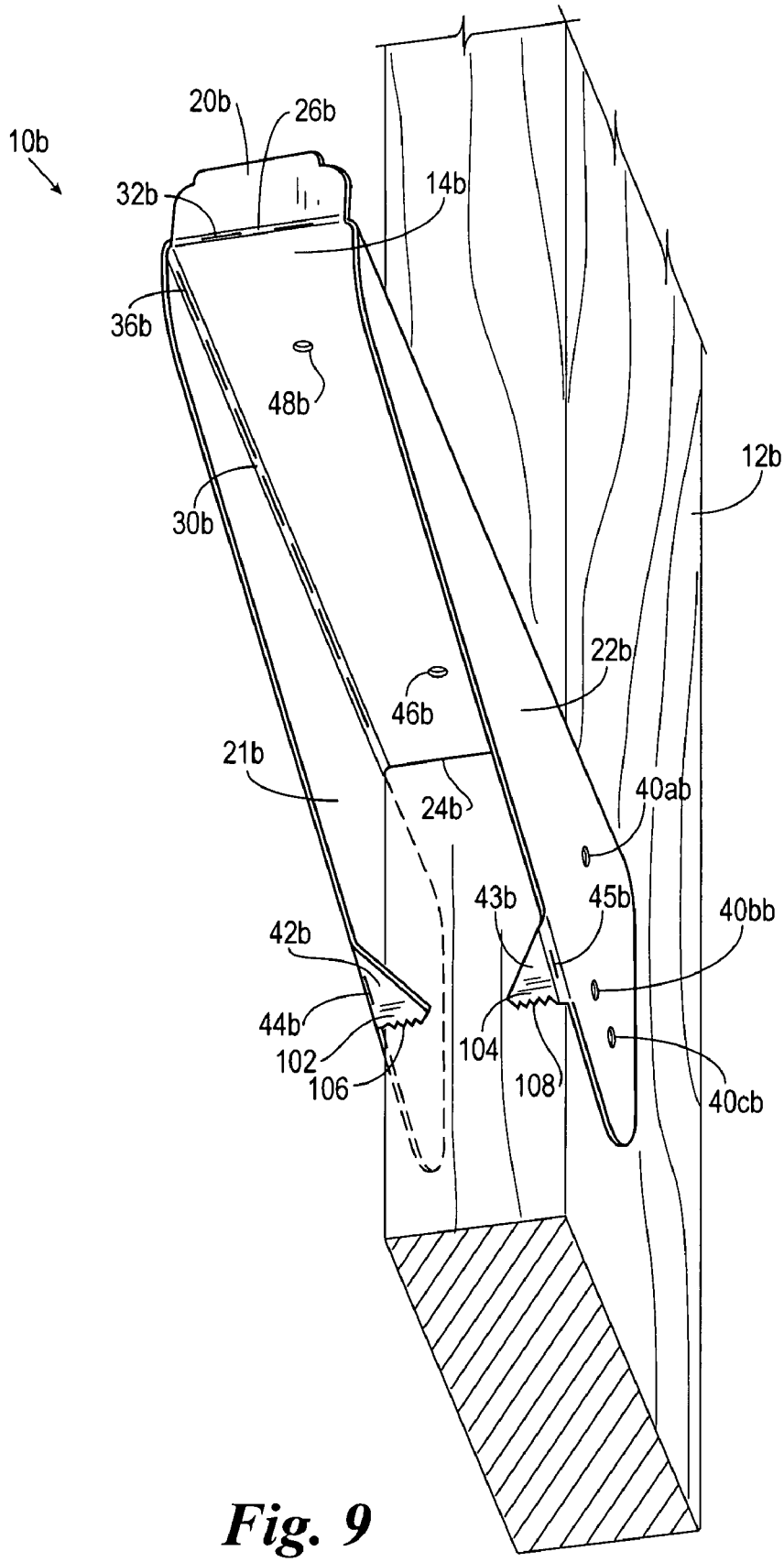
FIG. 9 is a perspective view showing an underside of an alternative embodiment of the shelf bracket, constructed in accordance with the present invention, connected to a support.

Referring now to FIG. 9, shown therein and designated by a reference numeral 10*b* is another version of a shelf bracket 10 constructed in accordance with the present invention. The shelf bracket 10*b* is similar in construction and function to the shelf bracket 10 described above with reference to FIGS. 1-4 respectively. The common features between the shelf bracket 10*b* and the shelf bracket 10 will not be described hereinafter for purposes of brevity. However, the common features will be labeled in FIG. 9 with the same numeric prefix followed by a "b" alphabetic suffix.

The shelf bracket 10*b* is provided with a first stiffener 42*b* and a second stiffener 43*b*. The first and second stiffeners 42*b* and 43*b* are provided with a first connector 102 and a second connector 104, respectively, for engaging a support 12*b*, such as a 2×4 piece of wood or other suitable structural support. The first and second connectors 102 and 104 are adapted to connect the first and second stiffeners 42*b* and 43*b* to the support 12*b*. In a preferred embodiment depicted in FIGS. 9 and 10, the first and second connectors 102 and 104 are provided with a plurality of teeth 106 and 108 for engaging the support 12*b* and connecting the first and second stiffeners 42*b* and 43*b* to the support 12*b*. The plurality of teeth 106 and 108 are designed so as to be forcibly embedded into the support 12*b* when a load is applied to the shelf bracket 10*b* and to resist outward bowing of the side members 21*b* and 22*b*. It should be understood and appreciated that the plurality of teeth 106 and 108 can be provided in various numbers (i.e. one tooth, two teeth, three teeth, four teeth, . . . N teeth), sized, and shaped in any manner so as to be forcibly embedded in the support 12*b*. For example, the teeth 106 and 108 can have a substantially "u" or "v" shape.

Figure 10:
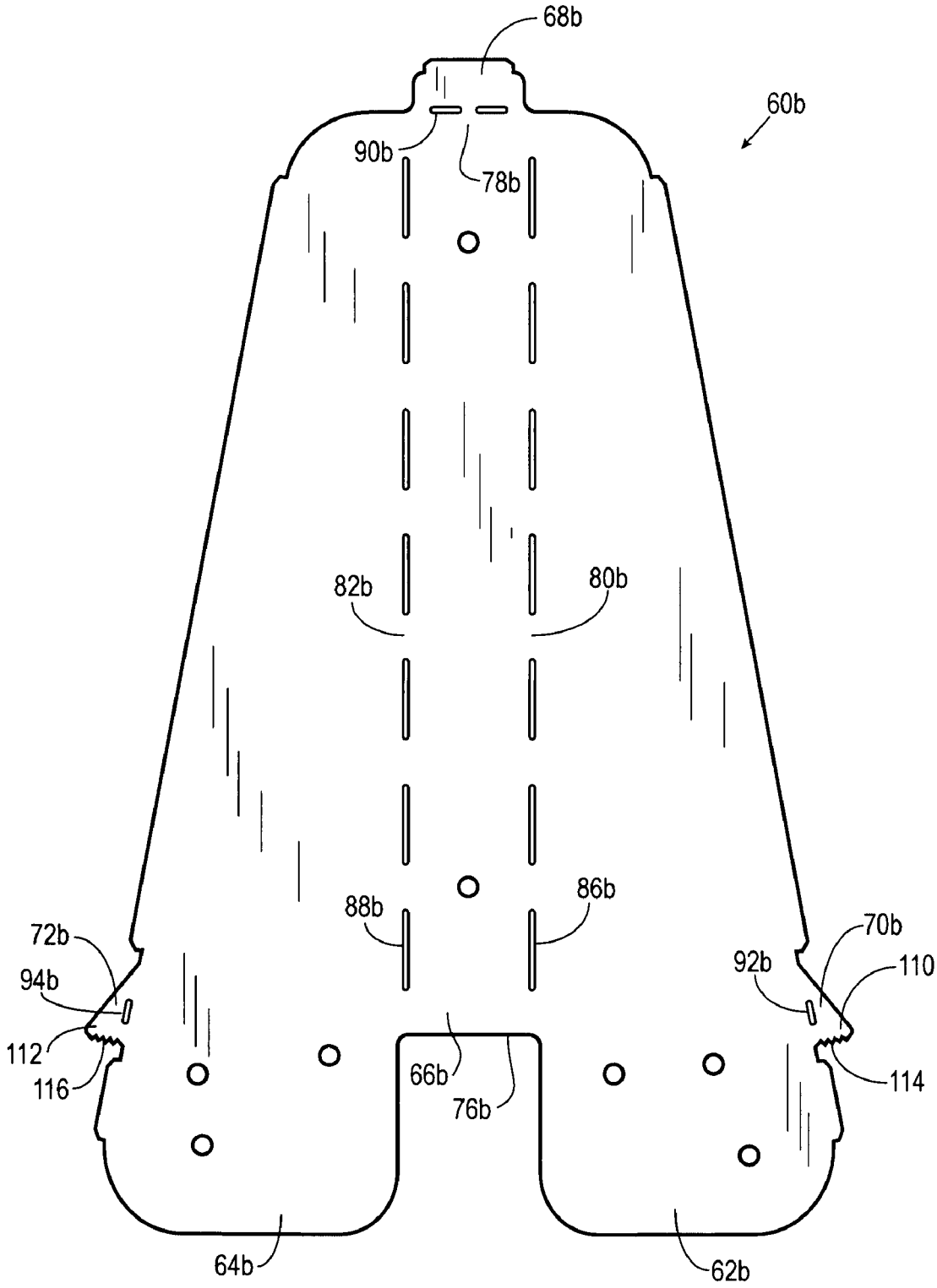
FIG. 10 is a top plan view of a blank utilized for forming the shelf bracket depicted in FIG. 9.

Referring now to FIG. 10, shown therein and designated by reference numeral 60*b* is another version of a blank 60 constructed in accordance with the present invention. The blank 60*b* is similar in construction and function to the blank 60 described above with reference to FIG. 4. The common features between the blank 60*b* and the blank 60 will not be described hereinafter for purposes of brevity. However, the common features will be labeled in FIG. 10 with the same numeric prefix followed by a "b" alphabetic suffix.

The blank 60*b* can be utilized for forming the shelf bracket 10*b*. The blank 60*b* is preferably constructed of a single sheet of material. The thickness, and/or construction of the material will vary based upon the desired use of the shelf bracket 10*b*. For example, where the shelf bracket 10*b* will be utilized at an individual's home for supporting rather small loads 16*b*, such as paint cans, the blank 60*b* can be constructed of a material such as 18-30 gauge steel or other light gauge material.

Like the blank 60 described above, the blank 60*b* is provided with a first stiffener portion 70*b* and a second stiffener portion 72*b*. The first stiffener portion 70*b* borders an outer side of the first side portion 62*b* and is separated therefrom by way of a bend line 92*b*. The second stiffener portion 72*b* borders an outer side of the second side portion 64*b* and is separated therefrom by way of a bend line 94*b*. Like the bend lines described above, the bend lines 92*b* and 94*b* can be formed from any suitable process for weakening the blank 60*b* in these areas. For example, the bend lines 92*b* and 94*b* can be formed by a series of circular cut outs, slots, or laser cutline(s).

The first and second stiffener portions 70*b* and 72*b* are provided with a first connector portion 110 and a second connector portion 112, respectively. In a preferred embodiment, the first and second connector portions 110 and 112 are provided with a plurality of teeth 114 and 116, respectively. The plurality of teeth 114 and 116 can be designed so that the plurality of teeth 114 and 116 are present in various numbers (i.e. one tooth, two teeth, three teeth, four teeth, . . . N teeth), sizes, and shapes. For example, the teeth 114 and 116 can have a substantially "u" or "v" shape.

The addition of the first and second connectors 102 and 104 to the shelf bracket 10*b* increases the stability and strength of the shelf bracket 10*b* over the shelf bracket 10. The shelf bracket 10*b* and the shelf bracket 10 were tested to determine the difference in the strength of the shelf bracket 10*b* compared to the shelf bracket 10. In this test, two shelf brackets 10 supporting a board, and two shelf brackets 10*b* supporting a similar board were mounted to 2×4 wood supports. Weight was added to the boards and the deformation of the side members of the shelf brackets 10 and 10*b* were monitored as the weight was added. The shelf brackets 10*b* supported twice as much weight as the shelf brackets 10 before deformation of the side members showed.

This is a large and certainly unexpected increase in performance due to the addition of the first and second connectors 102 and 104 to the first and second stiffeners 42*b* and 43*b*. Further, both of the shelf brackets 10 and 10*b* can be formed from blanks 60 and 60*b* that are cut or formed from a unitary piece of material, such as sheet steel. The addition of the first and second connectors 102 and 104 typically does not add any additional expense to the construction of the blank 60*b*, but the performance of the shelf bracket 12*b* basically doubles the performance of the shelf bracket 12.

Further, although the first and second connectors 102 and 104 are shown by way of example as the teeth 106 and 108, it should be understood that the first and second connectors 102 and 104 can be implemented as any device or configuration for connecting the first and second stiffeners 42*b* and 43*b* to the support 12*b*. For example, the first and second connectors 102 and 104 can be implemented as tabs extending from the first and second stiffeners 42*b* and 43*b* and delineated therefrom with a weakened area so that the tabs can be bent, preferably by hand or with the use of a hand-held tool, to be positioned against the support 12*b*. One or more eyelet or hole capable of receiving a screw or nail can be formed through each of the tabs to connect the first and second stiffeners 42*b* and 43*b* to the support 12*b*. Alternatively, the first and second connectors 102 and 104 can be implemented as a spike capable of being forced or driven into the support 12*b*. In either case, it is preferred that the blank 60*b* be formed to provide the first and second connectors 102 and 104 when the blank 60*b* is formed into the shelf bracket 12*b*.

Figure 11:
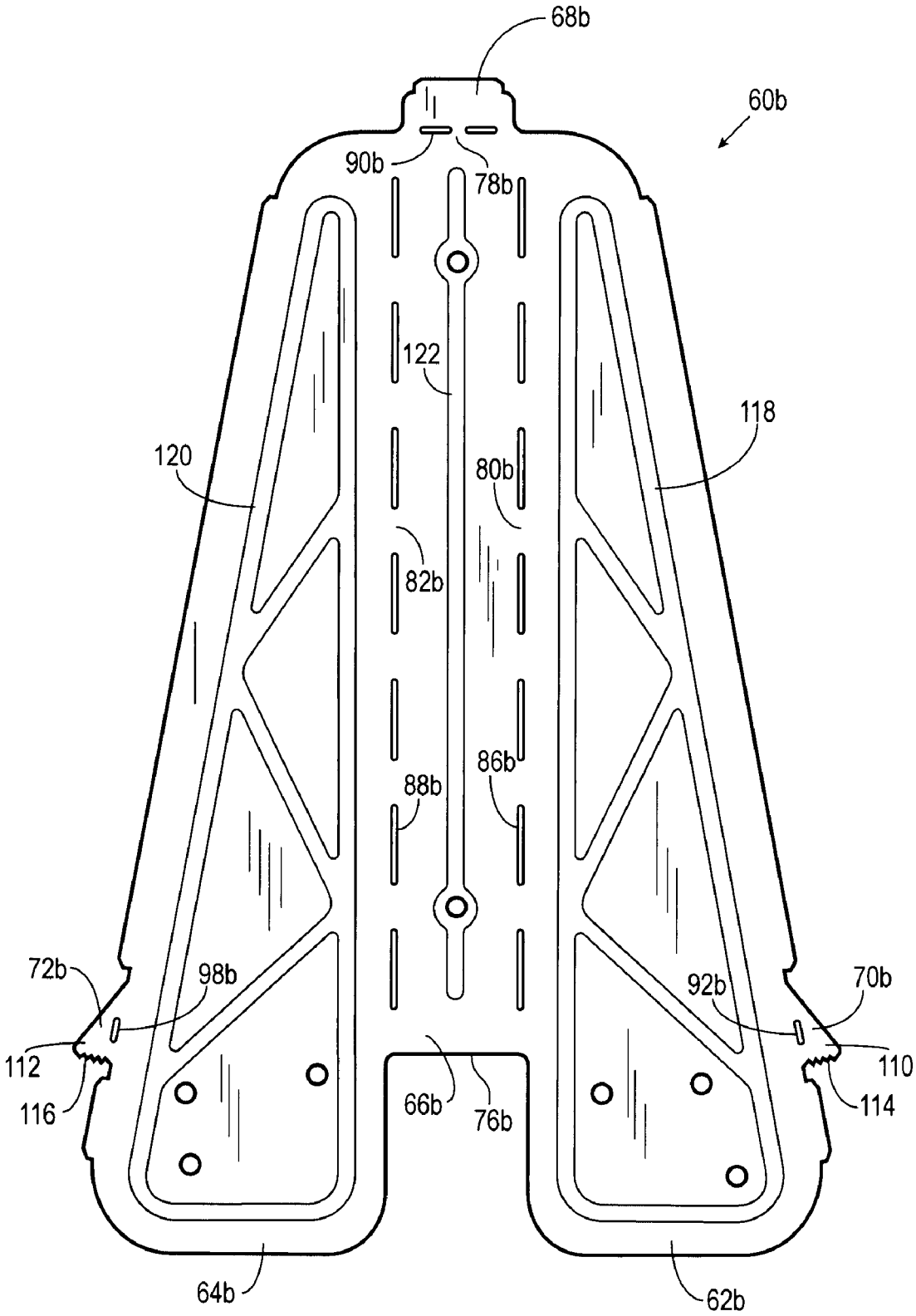
FIG. 11 is a top plan view of the blank utilized for forming the shelf bracket depicted in FIG. 5 having rib portions formed in the side portions.

In another embodiment, shown in more detail in FIG. 11, the blank 60*b* is provided with a first side portion 62*b*, a second side portion 64*b*, and a ledge portion 66*b*. The first side portion 62*b*, the second side portion 64*b*, and the ledge portion 66*b* are provided with a first rib portion 118*b*, a second rib portion 120*b*, and a third rib portion 122*b*, respectively. The rib portions 118*b*, 120*b*, and 122*b* can be sized and shaped in any suitable manner to provide strength to the shelf bracket 10*b* created from the blank 60*b*. The rib portions 118*b*, 120*b*, and 122*b* are formed, shaped, and function similarly to the ribs 50 and the rib portions 100 described above.

It should be understood that the figures are not necessarily to scale and certain features and certain views of the figures may be shown exaggerated in scale or in schematic in the interest of clarity and conciseness. It will also be understood from the foregoing description that various modifications and changes may be made in the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an," and other singular terms are intended to include the plural forms thereof unless specifically excluded.

What is claimed is:

1. A blank constructed from a sheet of material and formable into a shelf bracket, the blank comprising:

a flat ledge portion having a first end, a second end, a first side, and a second side;

a first side member extending from the first side of the ledge portion and having a first support member connecting portion extending beyond the first end of the ledge portion;

a second side member extending from the second side of the ledge portion and having a second support member connecting portion extending beyond the first end of the ledge portion;

a first bend line positioned between the ledge portion and the first side member and a second bend line positioned between the ledge portion and the second side member, the first bend line and second bend line comprising one or more cutouts thereby forming weakened areas in the bend lines such that the first side member and second side member are manually bendable relative to the ledge portion;

a first stiffener portion extending from the first side member and a second stiffener portion extending from the second side member; and a first stiffener bend line comprising a cutout and positioned between the first side member and the first stiffener portion and a second stiffener bend line comprising a cutout and positioned between the second side member and the second stiffener portion; and wherein the first stiffener bend line being at an acute angle with the first bend line and the second stiffener bend line being at an acute angle with the second bend line; and wherein each stiffener portion has a connecting means; and wherein the blank is formable into a shelf bracket by manually bending the first side member along the first bend line and manually bending the second side member along the second bend line such that each first and second side member is in perpendicular orientation to the ledge portion, and wherein when the blank is formed into the shelf bracket, the first support member connecting portion of the first side member and the second support member connecting portion of the second side member together form a cavity sized and adapted to receive and be attached to a support member having a planar surface and wherein when the shelf bracket is attached to the support member via the first and second support member connecting portions, the ledge portion extends from the planar surface of the support member substantially at a 90 degree angle and the first bend line and second bend line, each of which has the one or more cutouts therein, and each extends from the planar surface of the support member substantially at a 90 degree angle; and wherein the connecting means of each stiffener portion is connectable to the planar surface of the support member for enhancing the strength of the first side member and second side member of the shelf bracket.

2. The blank of claim 1, further comprising:

a lip portion extending from the second end of the ledge portion; and a bend line positioned between the second end of the ledge portion and the lip portion, and the bend line of the lip portion comprising a cutout; and wherein a lip is formable in the shelf bracket by manually bending the lip portion of the blank upwardly from the ledge portion of the blank.

3. The blank of claim 1, wherein the connecting means include at least one tooth for engaging the support member.

4. The blank of claim 1, wherein each first side member and second side member has a plurality of openings for receiving securing means for attaching the shelf bracket to the support member.

5. The blank of claim 1, wherein the ledge portion of the blank has a plurality of openings, such that a load can be secured to the ledge portion of the shelf bracket.

6. The blank of claim 1, wherein the cutouts of the bend lines comprise slots.

7. The blank of claim 1, further comprising at least one rib on each of the first side member and the second side member.

8. The blank of claim 1, further comprising at least one rib positioned in the ledge portion.

* * * * *